US005842630A

United States Patent [19]

Remer

[11] Patent Number: 5,842,630

[45] Date of Patent: Dec. 1, 1998

[54] STRUCTURE FORMED OF A SINGLE SHEET OF FOLDABLE MATERIAL FOR CONTAINING THREE DIMENSIONAL OBJECTS

[76] Inventor: Daniel J. Remer, 3 Marie St., Sausalito, Calif. 94965

[21] Appl. No.: 4,750

[22] Filed: Jan. 9, 1998

[51] Int. Cl.[6] ..... B65D 5/24

[52] U.S. Cl. ..... 229/116; D9/431; 229/116.1; 229/186; 493/162

[58] Field of Search ..... 229/115, 116, 229/116.1, 186; D9/431; 493/162, 183, 453

[56] References Cited

U.S. PATENT DOCUMENTS

| | | | |
|---|---|---|---|
| 490,680 | 1/1893 | Roberts | 229/116 |
| 628,465 | 7/1899 | Horning | 229/116 |
| 658,849 | 10/1900 | Jack et al. | 229/116 |
| 1,095,671 | 5/1914 | Pitkin | 229/116 |
| 2,054,302 | 9/1936 | Scoles | 229/186 |
| 2,935,238 | 5/1960 | Koehler | 229/116 |
| 3,485,202 | 12/1969 | Platt, III | 229/116 |
| 4,133,137 | 1/1979 | Van Adelsberg | 229/116 |
| 4,798,747 | 1/1989 | Laramee | 229/116 |
| 4,881,685 | 11/1989 | Isao | 229/115 |
| 5,225,254 | 7/1993 | Foulke | 229/116 |

FOREIGN PATENT DOCUMENTS

| | | | |
|---|---|---|---|
| 559093 | 9/1923 | France | 229/115 |
| 406051 | 7/1966 | Switzerland | 229/116.1 |

*Primary Examiner*—Gary E. Elkins

*Attorney, Agent, or Firm*—Charles J. Kulas; Townsend and Townsend and Crew

[57] ABSTRACT

The present invention is a pyramid-shaped structure formed of a single sheet of foldable material, such as a sheet of paper. Two embodiments are disclosed. The first embodiment maximizes the amount of volume contained by the pyramid-shaped structure. The embodiment encloses a smaller volume than the first embodiment but maximizes structural strength, or rigidity, of the structure. Each embodiment has certain advantages. The first embodiment can be efficiently created with a minimal number of folds. It can be "collapsed" from a single sheet of pre-creased material to instantly form a structure. It is also easily opened in a single motion. The second embodiment provides an extremely strong pyramid structure that can be formed around an object for complete containment of the object. Other uses are possible such as providing a tent-like housing for a person by cutting an opening in one of the sides.

11 Claims, 8 Drawing Sheets

STRUCTURE FORMED OF A SINGLE SHEET OF FOLDABLE MATERIAL FOR CONTAINING THREE DIMENSIONAL OBJECTS

BACKGROUND OF THE INVENTION

This invention relates in general to structures formed of foldable material and more specifically to a structure formed of such material suitable for containing three dimensional objects.

The art of origami dates back for many years and is well-known among its practitioners. Traditionally, this Japanese paper folding technique uses a single sheet of paper folded in clever ways to create artistic or useful shapes. For example, animal shapes such as birds, frogs, horses, etc., can be formed. Or useful shapes such as functional cups, trays, balloons, etc., may be created.

Many traditional folded structures can be found in books, and other educational material, which instruct as to the proper way to fold a sheet of paper to achieve the structure. These references draw upon the great body of origami folklore, information passed on from person to person throughout the years, to document specific folded structures. More recently, some folded structures have been the subject of patents issued by the U.S. Patent and Trademark Office.

For example, patent application Ser. No. 3,878,638 to Benjamin describes a method for instructing a student in folding a sheet of paper to create a "cup" and "gift box." U.S. Pat. No. 4,021,950 to Asija shows a folded structure forming a game and magic device. U.S. Pat. No. 5,314,112 to Jones shows how to fold a single sheet of material into a "folder" that provides a rectangular container. U.S. Pat. No. 5,365,684 to Cartmell shows an origami-style picture frame.

Although the prior art discloses clever and useful structures formed of a foldable sheet of material, none of these prior art structures provides a structure that can be easily made to efficiently contain three dimensional objects within an enclosed volume. Benjamin's "gift box" is really a tray with an open top and does not enclose the volume. Similarly, Benjamin's cup has, as cups do, an open section. Jones' "folder" is also a tray with an open side. Asija's "magic device" discusses an "aperture" within which an object can be exhibited. However, the aperture is made of laminations of papers, plastic or other flat material and is thus not formed solely of a single sheet of material. Further, the aperture does not permit any significant volume for containing a three dimensional object, but rather is designed to hold flat objects such as a coin or resume. Cartmell's folded structure is a picture frame that frames an object but does not enclose it. Thus, the prior art does not disclose a structure formed of a single sheet of foldable material that sufficiently encloses a volume so as to contain a three dimensional object. Further, structures such as Asija and Cartmell do not use a single sheet of material but require pre-cutting the material or laminating layers of material.

It is therefore desirable to create a structure formed simply and efficiently from a single sheet of material that can be used to enclose, or contain, three dimensional objects. Further, it is desirable for a structure to maximize the amount of enclosed volume with a given size sheet of material and, additionally, to provide a sturdy structure.

SUMMARY OF THE INVENTION

The present invention is a pyramid-shaped structure formed of a single sheet of foldable material, such as a sheet of paper. Two embodiments are disclosed. The first embodiment maximizes the amount of volume contained by the pyramid-shaped structure. A second embodiment encloses a smaller volume than the first embodiment but maximizes structural strength, or rigidity, of the structure. Each embodiment has certain advantages.

The first embodiment can be efficiently created with a minimal number of folds. It can be "collapsed" from a single sheet of pre-creased material to instantly form the pyramid structure. It is also easily opened in a single motion.

The first embodiment provides a structure formed from a single square sheet of foldable material, the structure having a bottom surface formed of a central portion of the sheet, a first side formed of the first corner portion of the sheet, a second side formed of a second corner portion of the sheet, a third side formed of a third corner portion of the sheet, and a fourth side formed of a fourth corner portion of the sheet where the structure is a pyramid shape with the four corners of the sheet meeting at the apex of the pyramid.

The second embodiment provides an extremely strong pyramid structure that can be formed around an object for complete containment of the object. Other uses are possible such as providing a tent-like housing for people by cutting an opening in one of the sides.

The second embodiment provides a structure formed from a single square sheet of foldable material, the structure having a bottom surface formed of a central portion of the sheet, a first structure side formed of a first sheet side portion, a second structure side formed of a second sheet side portion, a third structure side formed of a third sheet side portion, and a fourth structure side formed of a fourth sheet side portion to produce a pyramid-shaped structure with the midpoints of the four sides of the sheet meeting at the apex of the pyramid.

DETAILED DESCRIPTION OF THE PREFERRED EMBODIMENTS

Two embodiments of the present invention are presented. Both embodiments are formed of a substantially square piece of paper or other suitable flat foldable material. For example, the material can be cardboard, canvas, plastic, sheet metal, etc. The first embodiment achieves a large-volume container that is easily formed, closed and opened, as desired. The second embodiment achieves a smaller volume, sturdier structure that is interlocked shut.

First, FIGS. 1–5B will be discussed in connection with the first embodiment of the invention.

Figure 1:
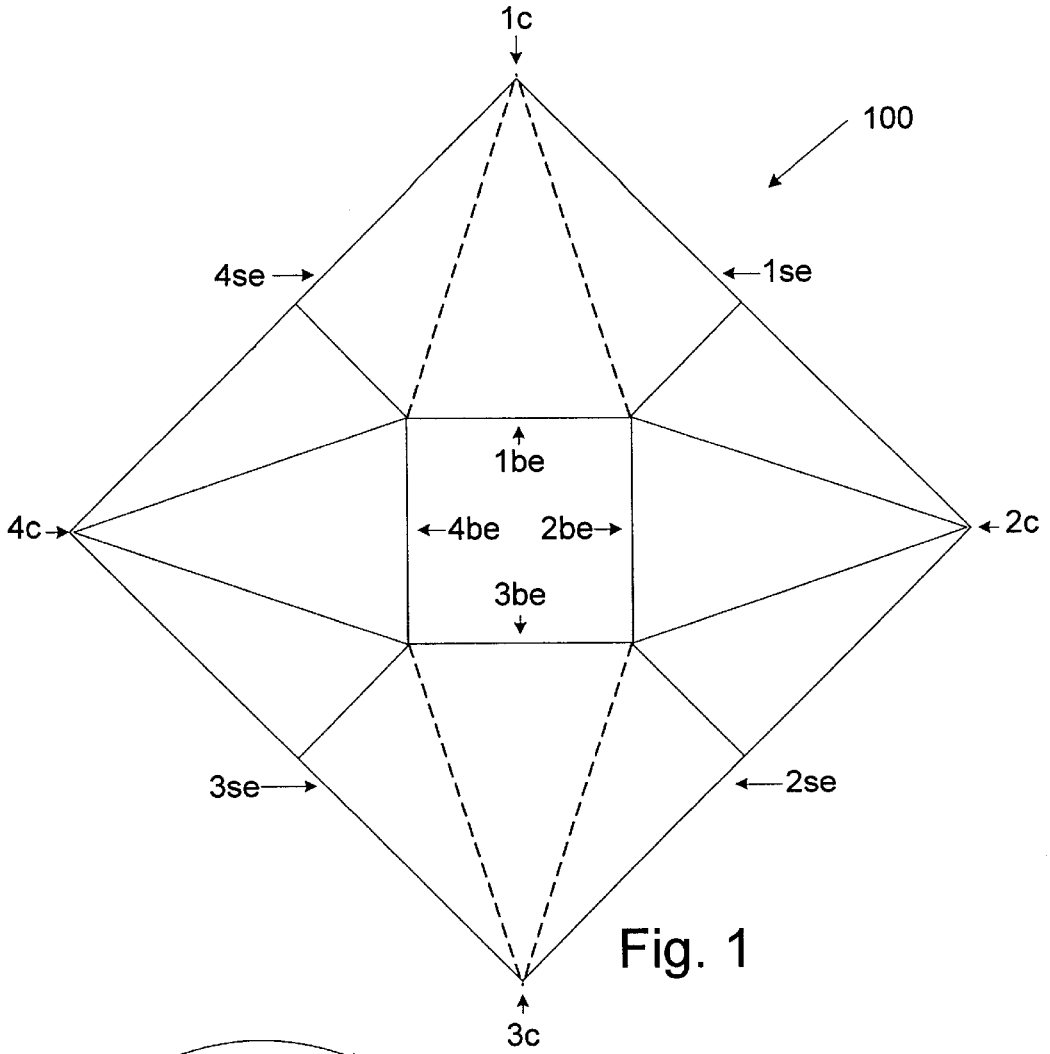
FIG. 1 shows a square sheet of paper with fold lines.

FIG. 1 shows a square sheet of paper 100 with primary fold lines. The solid and dashed fold lines within sheet 100 show the folds necessary to create the structure of the first embodiment. The solid lines in FIG. 1 indicate folds made by moving the paper upward to create the fold. Dashed lines represent folds made by folding the paper downward, or into the Figure. In other words, solid lines represent "valleys" while dash lines represent "peaks" with respect to the point of view of someone looking at FIG. 1. While FIG. 1 shows all of the folds necessary to create the first embodiment, additional folds, referred to as "construction folds," are used as an aid to constructing the structure when, for example, the structure is made by hand. The construction folds allow a person to more accurately make the folds ultimately used to form the structure, referred to here as "primary" folds.

Figure 2A:
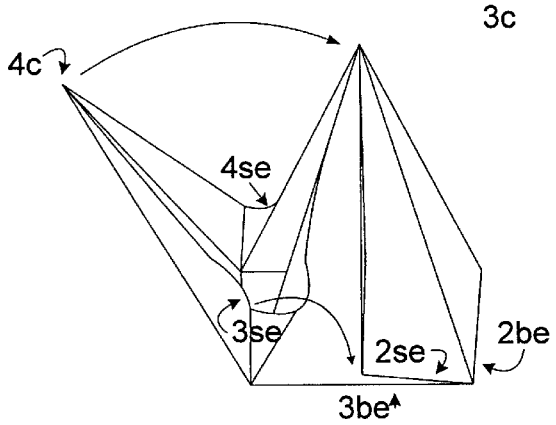
FIG. 2A shows an almost-complete first embodiment structure made using the primary folds shown in FIG. 1.
Figure 2B:
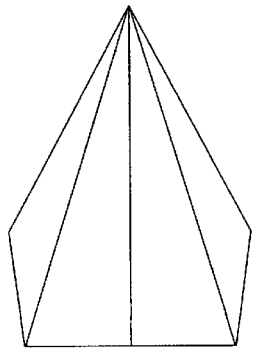
FIG. 2B shows a completed first embodiment structure.

FIG. 2A shows an almost-complete first embodiment structure made using the primary folds shown in FIG. 1. In FIG. 2A, the left side of the pyramid structure is shown partially opened as an aid in understanding the correspondence of the primary folds, shown in FIG. 1, with the structure shown in FIG. 2A. The completed structure is shown in FIG. 2B.

Reference numbers are used, as shown, in FIG. 1 as follows: Reference numbers 1*c*, 2*c*, 3*c* and 4*c* correspond to first, second, third and fourth corners of the sheet, respectively. 1*se*, 2*se*, 3*se* and 4*se* correspond to first, second, third and fourth "sheet edges" as shown. 1*be*, 2*be*, 3*be* and 4*be* correspond to first, second, third and fourth "bottom edges." 1*be*–4*be* are ultimately the bottom edges of the completed structure. For example, bottom edge 3*be* is shown in FIG. 2A. This is the same edge shown as 3*be* in FIG. 1. Other reference numerals identically used in FIG. 2A represent the same portions of sheet 100 as referenced in FIG. 1.

As can be seen from a comparison of reference numbers between FIGS. 1 and 2A, a property of the first embodiment is that corners l*c*–4*c* of sheet 100 meet at an apex of the pyramid as shown in FIG. 2A. Another property of the embodiment structure is that midpoints of the side edges meet at a midpoint of two of the bottom edges of the completed structure. For example, in FIG. 2A, side edges 2*se* and 3*se* have their midpoints folded over onto the midpoint of bottom edge 3*be*. Similarly, side edges 4*se* and 1*se* (note: 1*se* is not shown in FIG. 2A as it is hidden behind the far side of the pyramid) are folded so that their midpoints will meet over the midpoint of bottom edge 1*be*.

Figure 3:
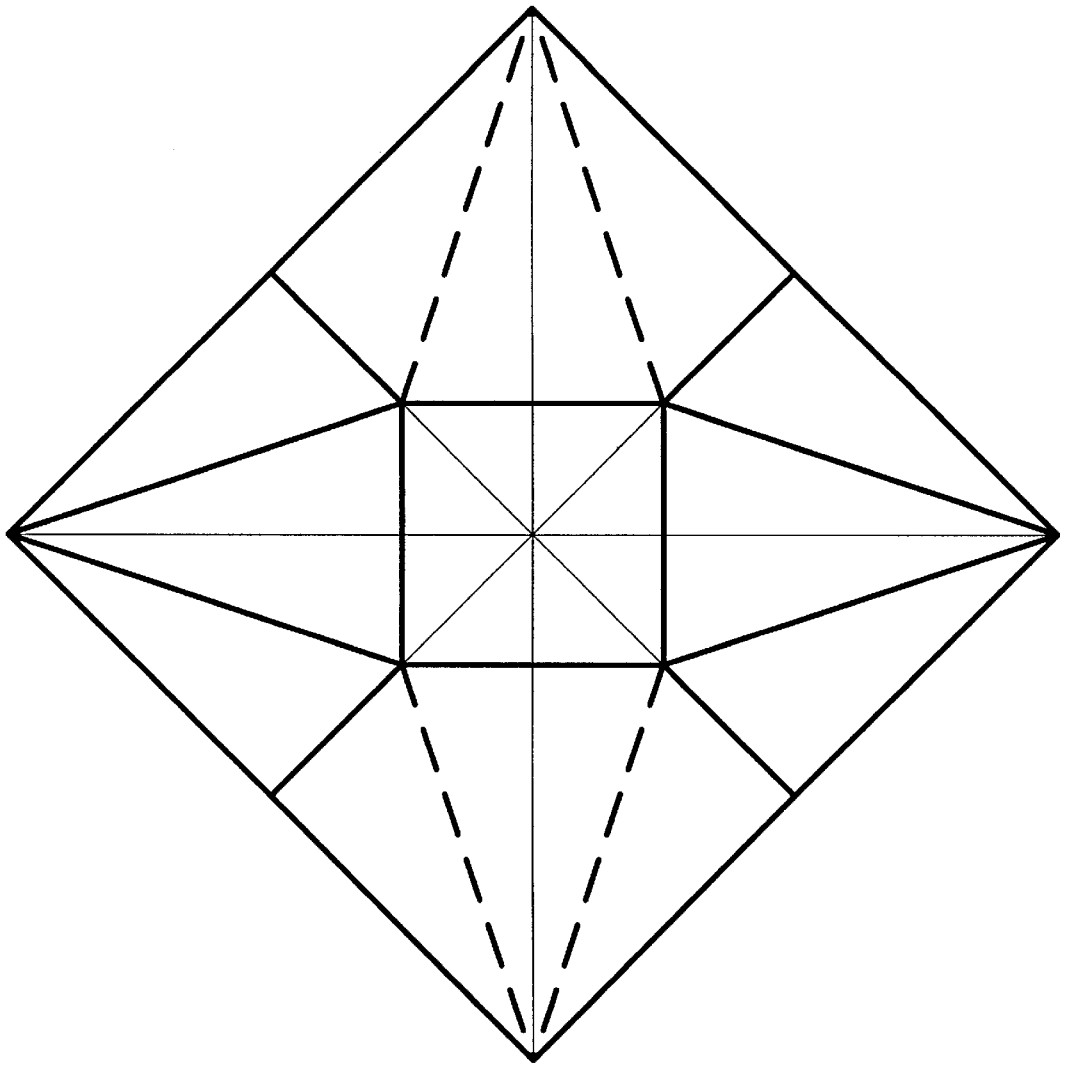
FIG. 3 shows a sheet with construction folds.

FIG. 3 shows sheet 100 of FIG. 1 along with additional construction folds used as an aid in forming the primary folds as discussed below. In FIG. 3, primary folds are shown in bold while construction folds are shown as thinner solid lines.

Next, FIGS. 4A–5B are discussed to illustrate how the construction folds are formed, and how the construction folds are used to create the primary folds. Finally, the creation of the complete structure from the resulting primary folds is discussed.

Figure 4A:
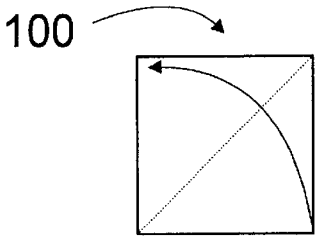
FIG. 4A shows a first diagonal fold.
Figure 4B:
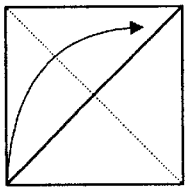
FIG. 4B shows a second diagonal fold.
Figure 4C:
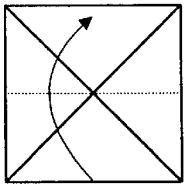
FIG. 4C shows the creation of a horizontal fold.
Figure 4D:
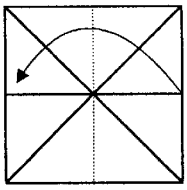
FIG. 4D shows the subsequent creation of a vertical fold.

FIGS. 4A–4L illustrate, in step-by-step fashion, all of the folds used to manually create the structure of the first embodiment. FIG. 4A shows a first diagonal fold in the direction of the arrow and along the dashed line. FIG. 4B shows a second diagonal fold perpendicular to the first diagonal fold of FIG. 4A. FIG. 4C shows the next step of creating a horizontal fold and FIG. 4D shows the subsequent step of creating a vertical fold.

Figure 4E:
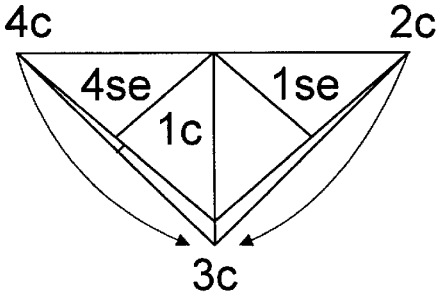
FIG. 4E shows two opposing corners being brought to a bottom corner.
Figure 4F:
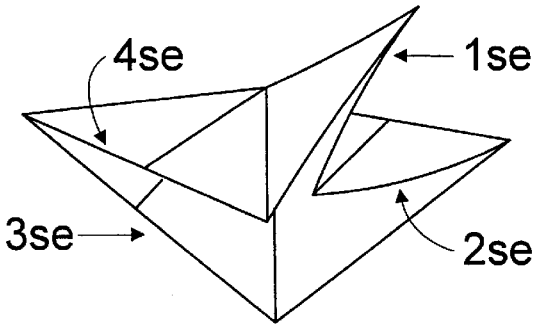
FIG. 4F shows the rightmost corner of FIG. 4*e*'s shape folded inward to meet at a bottom point.

Once the four construction folds of FIGS. 4A–4D are formed, the sheet is opened and folded along one of the diagonal folds to create the shape shown in FIG. 4E. The arrows in FIG. 4E show the next step of two opposing corners being brought to the bottom corner of FIG. 4E's shape. FIG. 4F shows the rightmost corner of FIG. 4E's shape being folded inward to meet at the bottom point of the inverted triangle shape. A symmetrical fold is made to the left corner of FIG. 4F to result in the shape of FIG. 4G. Note that the reference numbers used in FIGS. 4E–4G relate to the reference numbers used in FIGS. 1 and 2A. Thus, FIG. 4G shows the first and second side edges' midpoints contacting each other while the fourth and third side edges' midpoints contact each other.

Figure 4G:
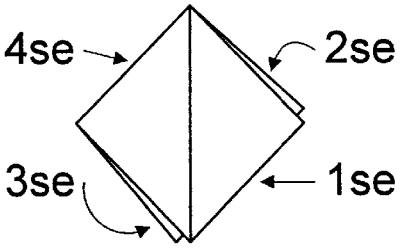
FIG. 4G shown the resultant shape performed in the operation shown in FIG. 4F.
Figure 4H:
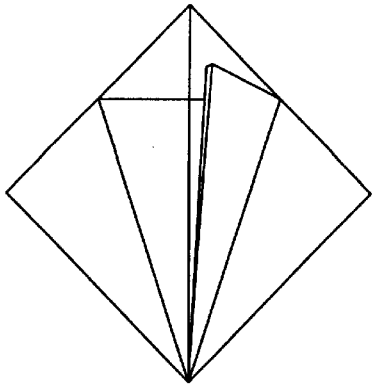
FIG. 4H shows the shape of FIG. 4G with right top corner folded upward and inward.

FIG. 4H shows the shape of FIG. 4G having a right, top corner formed of first sheet edge 1*se* being folded upward and inward to a center point of shape 4H. Similarly, the corner formed of the fourth sheet edge 4*se* is folded upward and inward to lie adjacent to 1*se*. Corners 2*se* and 3*se* are folded downward, that is, away from the viewer, to meet at the far side of the center of shape 4H.

Figure 4I:
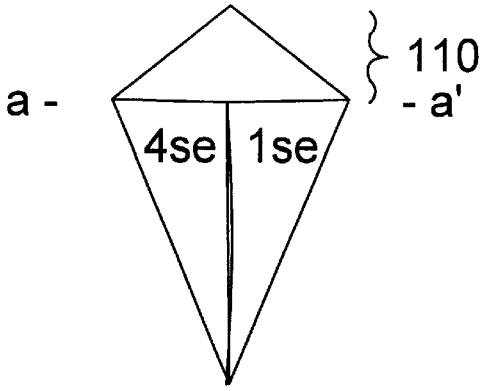
FIG. 4I shows a shape where corners abut each other on a top surface.

In this way, the shape of FIG. 4I is created where corners 4*se* and 1*se* abut each other on the top surface and corners 3*se* and 2*se* abut each other on the bottom surface (not visible).

Once the shape of FIG. 4I is achieved, top portion 110 is folded back-and-forth along fold a–a', that is, both towards and away from the viewer. This maneuver is used to insure an easy bend along this line at a later step in "inflating" the completed structure.

Figure 4J:
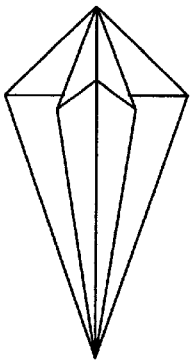
FIG. 4J is a first figure showing foreshortening of the shape.
Figure 4K:
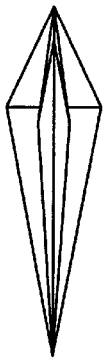
FIG. 4K is a second figure showing foreshortening of the shape.
Figure 4L:
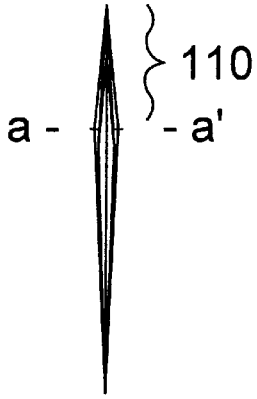
FIG. 4L is a third figure showing foreshortening of the shape.

FIGS. 4J–4L show the step of folding over the two top and two bottom corners of the shape in FIG. 4I so that the two top corners meet at a point near the viewer, or above the page, while the two bottom corners meet at a point away from the viewer, or below the page. FIG. 4K shows the shape being foreshortened as the two top corners are swung upwards to meet each other and as the two bottom corners are swung downwards to meet each other. FIG. 4L shows the final foreshortening of the figure where the paper used to create the shape of FIG. 4L is now being viewed essentially edge-on. Once this shape of FIG. 4L is achieved, top portion 110 is now folded left to right, instead of forward and backward as before, along line a–a'. Thus, the folding illustrated in FIGS. 4I–4L creates a bending in two dimensions, first front to back, and then side to side, of the top portion 110. Top portion 110 will actually become the bottom of the pyramid of the finished structure.

Figure 5A:
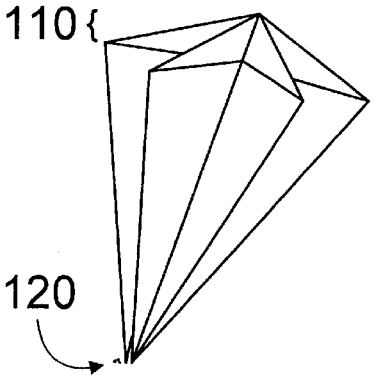
FIG. 5A shows a first perspective view of the first embodiment in a stage of expansion.

FIG. 5A shows a perspective view of the pyramid structure in its first stages of expansion. FIG. 5A is achieved from expanding FIG. 4L by, for example, expelling air in the direction of 120 into the apex of the pyramid shown in FIG. 5A. In FIG. 5A, portion 110 is now shown as a three dimensional folded base that is being expanded.

Figure 5B:
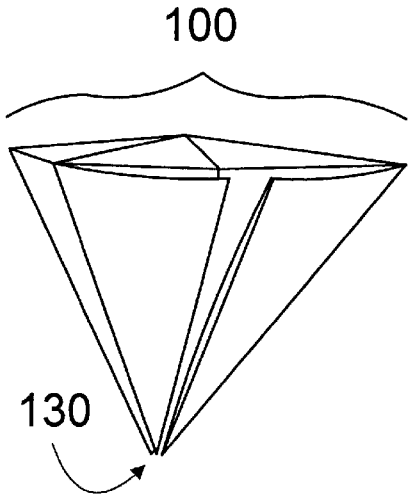
FIG. 5B shows a second perspective view of the first embodiment in a later stage of expansion.

FIG. 5B shows the pyramid structure in almost its complete expansion. Note that portion 110 is now flattened to become the base of the pyramid. The pyramid is in an upside-down orientation from that shown in FIG. 2A.

As discussed above, the original four corners of sheet 100 are meeting at the apex of the pyramid, shown in FIG. 5B as apex 130. As can be seen from the figures and reference numbers, the midpoints of the sheet edges are abutting, or meeting midpoints on the bottom edge of the structure.

Thus, an efficient and simple method for forming the first embodiment has been shown. Note that different ways of manufacturing the embodiment are possible. For example, although a manual method of forming the structures has been discussed, an automated method can be employed. In the automated method, a machine can be used to pre-fold, or pre-score the primary folds shown in FIGS. 1 and 8. These primary folds can be created with, or without, the aid of construction folds as discussed above.

In the first embodiment, once the primary folds are formed, or pre-defined by folding or scoring, or by other means, the application of pressure along two or more symmetrical points of the flat sheet in the direction of formation of the pyramid shape is sufficient to cause the entire pyramid structure to form. In other words, assuming the sheet of FIG. 1 with pre-scoring as indicated by the solid and dashed lines, an application of symmetrical force along two or more of the sides, or apexes of the sheet is enough to cause the entire structure to "collapse" into shape. Also, once the pyramid shape is achieved, it is a simple matter to instantly open the shape to reproduce the flat sheet and reveal any objects contained within the pyramid shape. Alternatively, although the shape has been discussed as a free-standing shape, an adhesive, such as glue or tape or connectors, etc., can be used to secure the four apexes at a common point. Many other variations on securing the structure are possible such as by adhering other points such as 3*se* and 4*se* together will suffice to secure the structure.

Next, FIGS. 6–11 are discussed to disclose a second embodiment of the invention.

A second embodiment of the invention results in a pyramid-shaped structure similar to the first embodiment discussed above. However, the pyramid-shaped structure of the second embodiment, given the same starting sheet dimensions, encloses a smaller volume and is stronger, or sturdier, than the first embodiment. Figures are presented analogously to those presented above for the first embodiment. Although identical reference numbers are used in FIGS. 6–11, these reference numbers do not correspond with the reference numbers in FIGS. 1–5B. Rather, there are two groupings for the reference numbers. Those used among FIGS. 1–5B, and those used among FIGS. 6–11.

Figure 6:
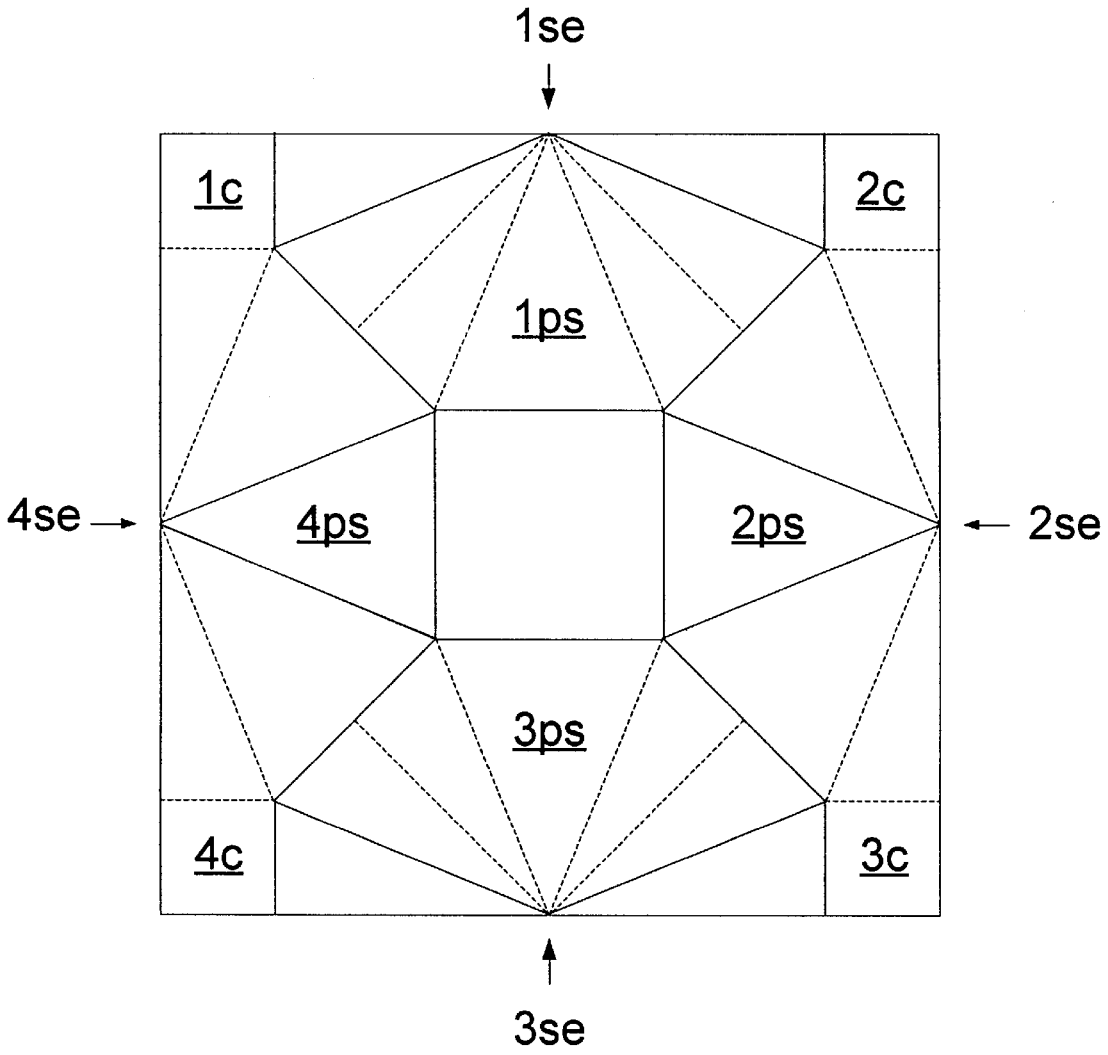
FIG. 6 shows a sheet for forming the second embodiment with lines indicating primary folds.

FIG. 6 shows sheet 200 with lines indicating primary folds for the second embodiment. Similar to the diagram of FIG. 1, dotted lines in FIG. 6 indicate "peaks" while solid lines in FIG. 6 indicate "valleys" in the folds from the perspective of someone viewing FIG. 6. Note that although the sheets are the same size in both FIG. 1 and FIG. 6, the square toward the center of sheet 200 is smaller than the square at the center of sheet 100. Since these square form the bases of the pyramids of each respective structure, this indicates that the base of pyramid structure achieved in the second embodiment has a smaller base than the pyramid structure of the first embodiment. Also, the pyramid sides labelled 1*ps*, 2*ps*, 3*ps*, and 4*ps* are smaller than the pyramid sides of sheet 100 in FIG. 1. Thus, the overall volume enclosed by the shape in the second embodiment will be smaller than the volume enclosed by the shape in the first embodiment.

Of interest, also, in comparing FIG. 6 with FIG. 1, is that the "tops" of the triangle sides of the pyramid in FIG. 1 are the corners of square sheet 100. In contrast, the tops of the triangle sides in FIG. 6 are the midpoints of the sides of sheet 200. In the first embodiment the pyramid structure is formed by folding the corners of the sheet to a common point to form the apex of the pyramid. In the second embodiment, the pyramid is formed by folding the midpoints of the sides of the sheet to meet at a common point to form the apex of the pyramid.

In FIG. 6, first, second, third and fourth sheet edges are labeled as, respectively, 1*se*, 2*se*, 3*se* and 4*se*. Corners of sheet 200 are labeled 1*c*, 2*c*, 3*c* and 4*c*. As will be shown below, a property of the pyramid structure of the second embodiment is that two pairs of sheet corners are folded so that they end up near the midsection of a sheet edge.

Figure 7A:
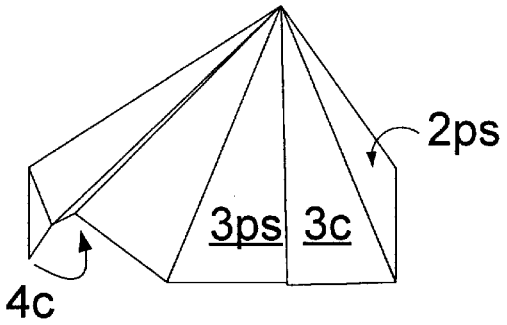
FIG. 7A shows the pyramid structure of the second embodiment in almost-complete form.

FIG. 7A shows the pyramid structure of the second embodiment almost complete. In FIG. 7A, all that is needed to complete the structure is to fold corner 4*c* in the direction of the arrow to complete an interlocking fold and then to fold the resulting left side flap over onto 3*ps* so that corner area 4*c* will abut corner area 3*c*.

Figure 8:
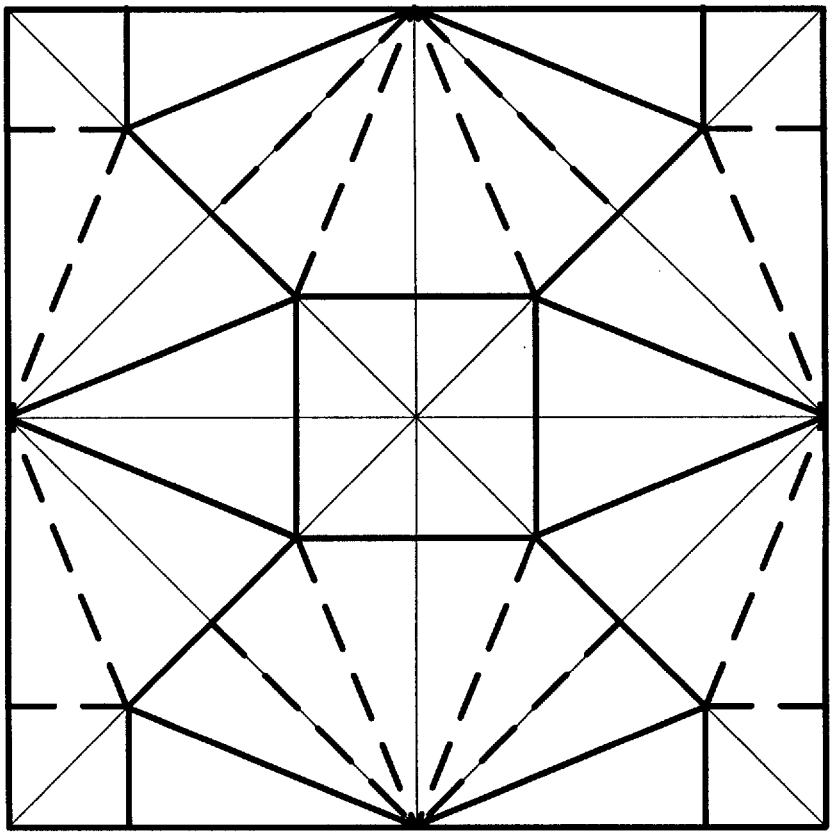
FIG. 8 shows primary folds and construction folds in addition to the primary folds.

FIG. 8 shows a diagram of FIG. 6 with the addition of construction folds. As discussed above, the construction folds, or lines, are formed as an aid to creating the primary folds, especially where the structure is being made manually. In FIG. 8, construction lines are shown as regular weight lines while the primary folds are shown in heavy solid and dashed lines. Although creation of the second embodiment will now be discussed in terms of manually folding the sheet, the folding can be automated. In the case where the folding is automated it may be desirable to pre-score, or pre-fold, the sheet in accordance with the primary folds shown in FIG. 6. One or more of the construction folds can be provided, as desired. They can either be actual folds made on the sheet or they may merely be lines drawn or printed onto the sheet for purposes of assisting in alignment and accuracy.

Figure 9A:
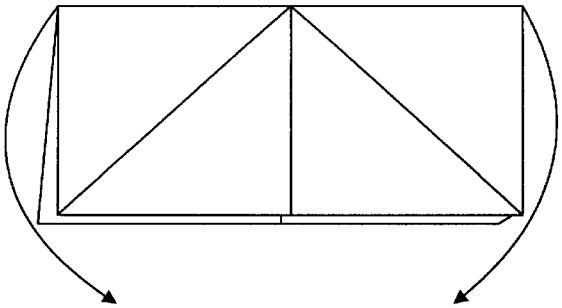
FIG. 9A shows a shape that is the result of performing the folds of FIGS. 4A–4D with the addition of a horizontal fold about a central line.

FIG. 9A shows a shape that is the result of performing the same folds as discussed above in connection with FIGS.

4A–D. Then, by folding the sheet along its horizontal central line, the rectangle with folded top edge is created, as shown in FIG. 9A.

The next step in creating the shape of the second embodiment is to fold the two corners in the directions of the arrows shown in FIG. 9A. This results in the shape shown in FIG. 9B.

Figure 9B:
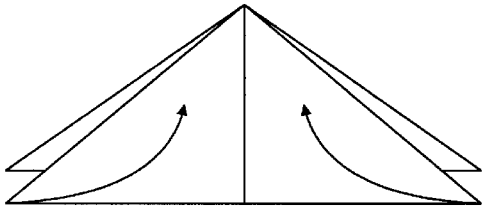
FIG. 9B shows a subsequent fold in the creation of the structure of the second embodiment.
Figure 9C:
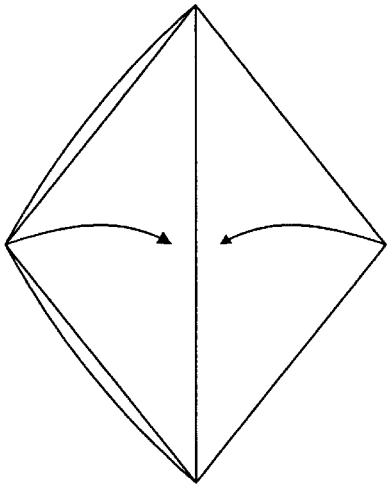
FIG. 9C shows two side corners of a diamond-shaped structure folded inward.

FIG. 9B shows the next two folds as being that of moving the left and right lower corners of the top triangle inward and upward to meet the upper corner of the top triangle. A similar maneuver is done for the bottom, or back, triangle to achieve the shape of FIG. 9C. From FIG. 9C the two side corners of the diamond-shaped structure are folded inward. The similar folds are made on the back of the shape of FIG. 9C. This results in the shape shown in FIG. 10A.

Figure 10A:
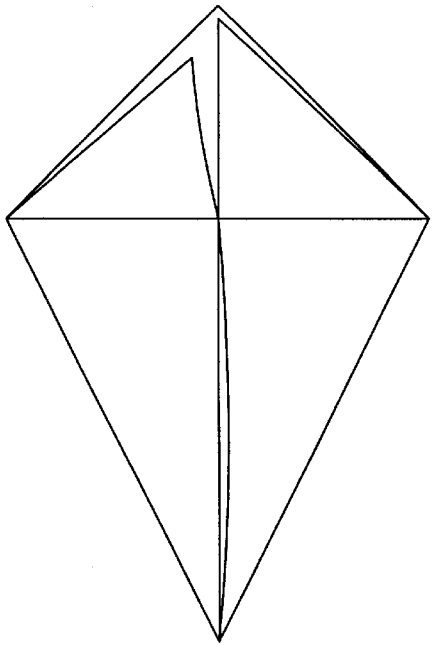
FIG. 10A shows an intermediate shape in the construction of the second embodiment with slight imperfections that folds and edges may be more easily discerned.

FIG. 10A shows the shape so far, with slight imperfections in the drawing so that the folds and edges may be more easily discerned. In FIG. 10A the top left flap of the kite-shape is shown folded slightly downwards, or towards the viewer. This flap will be used to interlock the left side of the kite shape. Similar interlocking using analogous flaps is performed for the right half of the side of the kite shape of FIG. 10A. Also, the same maneuver will then be performed on the opposite side of FIG. 10A to interlock the two flaps on the opposite side (not shown).

Figure 10B:
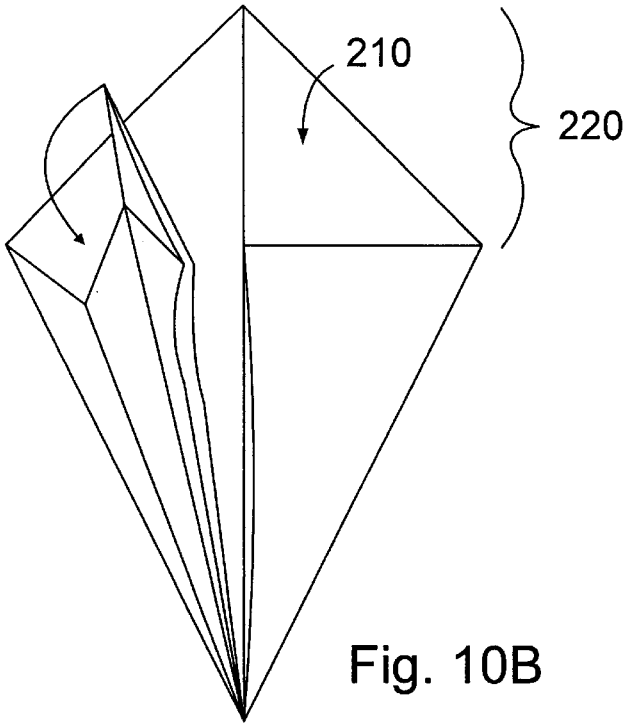
FIG. 10B shows the operation of folding the left top flap to create a sturdy left side in the second embodiment.

FIG. 10B shows the operation of folding the left top flap to create a sturdy left side. The top left flap is folded in the direction of the arrow so that it effectively "grips" the sheet material on the opposite side. The left side is then re-folded back into place. The same maneuver is done for flap 210 on the right side of the kite shape of FIG. 10B. These same interlocking folds are performed on the opposite side of FIG. 10B by flipping the shape of FIG. 10B over and performing identical folds to the other side (not shown).

Figure 10C:
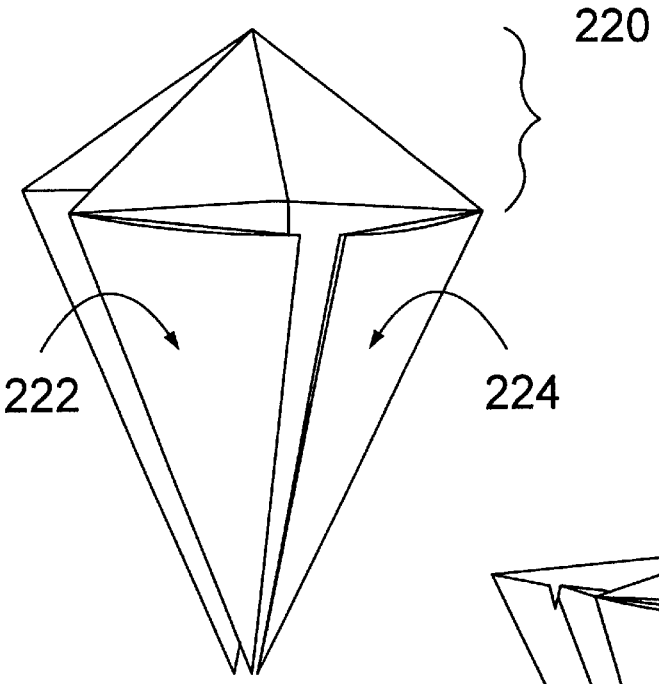
FIG. 10C is a first perspective view of the structure of the second embodiment partially expanded.

FIG. 10C is a perspective view of the structure half way through expanding the structure to form the completed pyramid. Prior to expanding the shape, and after performing the interlocking folds discussed above in connection with FIG. 10B, the top portion 220 of the kite structure of FIG. 10B is folded forward and backward similar to what was described above in connection with FIG. 4L for the first embodiment. Again, this back-and-forth bending makes the fold more flexible for easier expansion of the shape, later. After the top portion is bent forward and backward, the shape of FIG. 10B is manipulated to bring its left and right front sides upward (i.e., toward to viewer) while its left and right back sides are brought backward (i.e., away from the viewer) to produce a foreshortened view of the shape similar to what was described above in connection with FIGS. 4K and 4L for the first embodiment. Top portion 220 is then folded to the left and right. This additional pre-folding makes it even easier to expand the structure.

FIG. 10C, as mentioned, shows the figure in a mid-state of being expanded. In FIG. 10C, the side of the structure nearest the viewer is also a side with two interlocked panels 222 and 224. The opposite side of the shape has two similar side flaps (not shown). Note that top portion 220 is being flattened as the shape is expanded. Top portion 220 ultimately forms the bottom portion of the pyramid in the final structure.

Figure 10D:
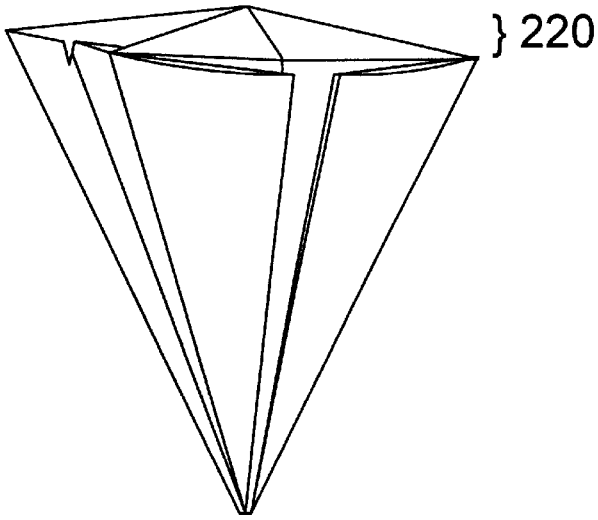
FIG. 10D is a second perspective view of the structure of the second embodiment further expanded.

FIG. 10D shows the shape almost completely expanded. Some wrinkles, as might be encountered when expanding the shape, have been depicted. Note that the top portion 220 is almost completely flattened to form the bottom of the pyramid shape. The pyramid is inverted at this point. To achieve the final shape as shown substantially in FIG. 7B, the shape of FIG. 10D needs to be further expanded and turned over to rest on its bottom portion 220.

Figure 7B:
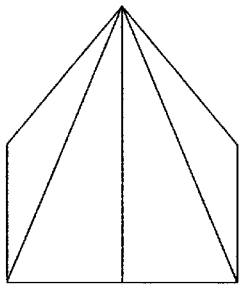
FIG. 7B shows the second embodiment in its completed form.

The resulting shape shown in FIG. 7B forms a four-sided pyramid structure that provides a high degree of structural strength. The structure is free-standing and maintains its shape relatively well. As mentioned before, various means can be used to secure different parts of the structure to give it added stability and strength. For example, glue, fasteners, etc. can be employed to affix the interlocking tabs to the material or to attach the side flaps of the structure to each other.

Figure 11:
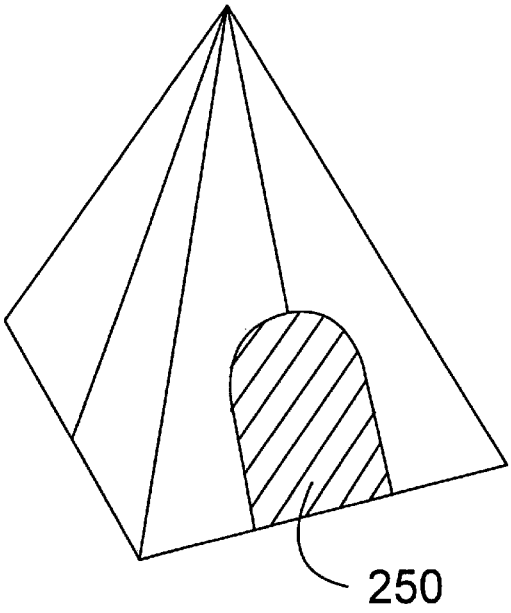
FIG. 11 shows the second embodiment in its final form, including a cutout.

FIG. 11 shows the structure with a cutout 250 that allows objects to be placed into, or taken out of, the structure. The cutout may be of different shapes and sizes and can be positioned anywhere on the structure, as desired. In FIG. 11, provided that the structure is made large enough, the structure can act as a "tent" or shelter for humans, animals, etc.

Although the invention has been presented with reference to specific embodiments, various modifications to the embodiments can be made without departing from the scope of the invention. The scope of the invention being defined, instead, by the appended claims.

What is claimed is:

1. A structure suitable for containing objects, the structure formed from a single square sheet of foldable material, the structure comprising:

a bottom surface formed of a central portion of the sheet;

a first side formed of a first corner portion of the sheet;

a second side formed of a second corner portion of the sheet;

a third side formed of a third corner portion of the sheet;

a fourth side formed of a fourth corner portion of the sheet; and wherein the structure is a pyramid shape with the four corners of the sheet meeting at the apex of the pyramid.

2. The structure of claim 1, the structure further comprising:

the first, second, third and fourth sides hinged to the bottom surface at first, second, third and fourth bottom edges, respectively;

a first sheet edge between the first and second corner portions;

a second sheet edge between the second and third corner portions;

a midpoint on the first sheet edge folded toward the midpoint of the first bottom edge; and a midpoint on the second sheet edge folded toward the midpoint of the third bottom edge.

3. The structure of claim 2, the structure further comprising:

a third sheet edge between the third and fourth corner portions;

a fourth sheet edge between the fourth and first corner portions;

a midpoint on the third sheet edge folded toward the midpoint of the third bottom edge; and a midpoint on the fourth sheet edge folded toward the midpoint of the first bottom edge.

4. A method for making a pyramid structure from a square sheet of foldable material, the method comprising the step of:

folding the four corners of the sheet toward a single point over the center of the sheet to create the pyramid structure.

5. The method of claim 4, further comprising the steps of:

folding the midpoints of the first and fourth sheet edges to a midpoint on the first bottom edge; and folding the midpoints of the second and third sheet edges to a midpoint on the third bottom edge.

6. A structure suitable for containing objects, the structure formed from a single square sheet of foldable material, the structure comprising:

a bottom surface formed of a central portion of the sheet;

a first structure side formed of a first sheet side portion;

a second structure side formed of a second sheet side portion;

a third structure side formed of a third sheet side portion;

a fourth structure side formed of a fourth sheet side portion; and wherein the structure is a pyramid shape with the midpoints of the four sides of the sheet meeting at the apex of the pyramid.

7. The structure of claim 6, the structure further comprising:

first and second corner portions of the sheet along the first sheet side portion folded toward the first structure side; and third and fourth corner portions of the sheet along the third sheet side portion folded toward the third structure side.

8. The structure of claim 7, the structure further comprising:

a cutout in one of the structure sides for access into the interior of the structure.

9. The structure of claim 7, wherein the cutout is in one of the second or fourth structure sides.

10. A method for making a pyramid structure from a square sheet of foldable material, the method comprising the step of:

folding the four midpoints of the sides of the sheet toward a single point over the center of the sheet to create the pyramid structure.

11. The method of claim 10, further comprising the steps of:

folding the corners of the sheet toward two of the four sides so as to further define the pyramid structure.

* * * * *